US010041357B2

(12) United States Patent
Hagan et al.

(10) Patent No.: US 10,041,357 B2
(45) Date of Patent: Aug. 7, 2018

(54) CORED AIRFOIL PLATFORM WITH OUTLET SLOTS

(71) Applicant: United Technologies Corporation, Hartford, CT (US)

(72) Inventors: Benjamin F. Hagan, Manchester, CT (US); Ryan Alan Waite, South Windsor, CT (US); Bryan P. Dube, Columbia, CT (US); Dominic J. Mongillo, Jr., West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 628 days.

(21) Appl. No.: 14/600,048

(22) Filed: Jan. 20, 2015

(65) Prior Publication Data

US 2016/0208618 A1 Jul. 21, 2016

(51) Int. Cl.

| | |
|---|---|
| ***F01D 5/18*** | (2006.01) |
| ***F01D 9/04*** | (2006.01) |
| ***F01D 25/12*** | (2006.01) |
| ***F01D 5/14*** | (2006.01) |
| ***F01D 5/22*** | (2006.01) |

(52) U.S. Cl.

CPC ..... *F01D 5/187* (2013.01); *F01D 5/147* (2013.01); *F01D 5/18* (2013.01); *F01D 5/225* (2013.01); *F01D 9/041* (2013.01); *F01D 25/12* (2013.01); *F05D 2220/32* (2013.01); *F05D 2230/211* (2013.01); *F05D 2240/12* (2013.01); *F05D 2240/30* (2013.01); *F05D 2240/81* (2013.01); *F05D 2260/202* (2013.01); *F05D 2260/22141* (2013.01)

(58) Field of Classification Search

None

See application file for complete search history.

(56) References Cited

U.S. PATENT DOCUMENTS

| | | | |
|---|---|---|---|
| 7,255,536 | B2 | 8/2007 | Cunha et al. |
| 7,766,606 | B2 | 8/2010 | Liang |

(Continued)

FOREIGN PATENT DOCUMENTS

| | | |
|---|---|---|
| EP | 0874131 | 10/1998 |
| EP | 1484476 | 12/2004 |

(Continued)

OTHER PUBLICATIONS

Extended European Search Report for European Application No. 16152007.7 dated Jul. 5, 2016.

*Primary Examiner* — Dwayne J White

*Assistant Examiner* — Jason Davis

(74) *Attorney, Agent, or Firm* — Carlson, Gaskey & Olds, P.C.

(57) ABSTRACT

An airfoil includes a platform that has platform leading and trailing ends, lateral side faces, and inner and outer faces. An airfoil portion extends outwardly from the inner face of the platform. The airfoil portion includes airfoil leading and trailing ends and side walls that join the airfoil leading and trailing ends. The platform includes a cooling passage that has an inlet at a forward location, outlet slots at the platform trailing end, and an intermediate passage portion that extends from the inlet to the outlet slots. The intermediate passage portion includes a common manifold region that feeds the outlet slots.

12 Claims, 4 Drawing Sheets

(56) References Cited

U.S. PATENT DOCUMENTS

| | | | | |
|---|---|---|---|---|
| 8,356,978 | B2 | 1/2013 | Beattie et al. | |
| 8,511,995 | B1 | 8/2013 | Liang | |
| 8,632,298 | B1 | 1/2014 | Liang | |
| 2009/0028692 | A1* | 1/2009 | Surace | F01D 5/187 415/115 |
| 2011/0044795 | A1* | 2/2011 | Chon | F01D 5/187 415/115 |
| 2011/0123310 | A1 | 5/2011 | Beattie et al. | |
| 2013/0004295 | A1 | 1/2013 | Naryzhny et al. | |
| 2013/0251508 | A1* | 9/2013 | Tardif | F01D 9/02 415/115 |
| 2014/0047843 | A1* | 2/2014 | Papple | F01D 5/187 60/726 |
| 2014/0219778 | A1 | 8/2014 | Boeke et al. | |

FOREIGN PATENT DOCUMENTS

| | | |
|---|---|---|
| EP | 2436882 | 4/2012 |
| GB | 1516757 | 7/1978 |
| GB | 2210415 | 7/1989 |
| JP | 2000220404 | 8/2000 |

* cited by examiner

CORED AIRFOIL PLATFORM WITH OUTLET SLOTS

STATEMENT REGARDING FEDERALLY SPONSORED RESEARCH OR DEVELOPMENT

This invention was made with government support under contract number FA8650-09-D-2923-0021 awarded by the United States Air Force. The government has certain rights in the invention.

BACKGROUND

Gas turbine engine airfoils, such as turbine blades and turbine vanes, can be fabricated by investment casting. For instance, in investment casting, a ceramic or refractory metal core is arranged in a mold and coated with a wax material, which provides a desired shape. The wax material is then coated with ceramic slurry that is hardened into a shell. The wax is melted out of the shell and molten metal is then poured into the remaining cavity. The metal solidifies to form the airfoil. The core is then removed, leaving internal passages within the airfoil. Typically, the passages are used for cooling the airfoil.

SUMMARY

An airfoil according to an example of the present disclosure includes a platform including platform leading and trailing ends, lateral side faces, and inner and outer faces. An airfoil portion extends outwardly from the inner face of the platform. The platform includes a cooling passage having an inlet at a forward location, outlet slots at the platform trailing end, and an intermediate passage portion extending from the inlet to the outlet slots. The intermediate passage portion includes a common manifold region that feeds the outlet slots.

In a further embodiment of any of the foregoing embodiments, the cooling passage is relatively wider in a lateral direction between the lateral side faces than in a thickness direction between the inner and outer faces.

In a further embodiment of any of the foregoing embodiments, the manifold region includes pedestals.

In a further embodiment of any of the foregoing embodiments, the manifold region includes elongated ribs.

In a further embodiment of any of the foregoing embodiments, the outlet slots open at the inner face.

In a further embodiment of any of the foregoing embodiments, the outlet slots open at the outer face.

In a further embodiment of any of the foregoing embodiments, the outlet slots open at an aft face on the platform trailing end.

In a further embodiment of any of the foregoing embodiments, the inlet opens at a cavity of the airfoil portion.

In a further embodiment of any of the foregoing embodiments, the inlet opens at the outer face.

In a further embodiment of any of the foregoing embodiments, the intermediate passage portion tapers in thickness from the inlet to the outlet slots.

In a further embodiment of any of the foregoing embodiments, the cooling passage extends over at least 50% of a length of the platform between the platform leading and trailing ends.

An airfoil according to an example of the present disclosure includes a platform having platform leading and trailing ends, lateral side faces, and inner and outer faces. An airfoil portion extends outwardly from the inner face of the platform. The platform includes a plurality of cooling passages. Each of the cooling passages has an inlet at a forward location and outlet slots at the platform trailing end. The cooling passages are relatively wider in a lateral direction between the lateral side faces than in a thickness direction between the inner and outer faces.

In a further embodiment of any of the foregoing embodiments, the platform includes a rib that is elongated in a length direction between the platform leading and trailing ends, the rib diving two of the cooling passages.

In a further embodiment of any of the foregoing embodiments, the rib is approximately midway between the lateral side faces.

In a further embodiment of any of the foregoing embodiments, the rib is closer in proximity to one of the lateral side faces than the other.

In a further embodiment of any of the foregoing embodiments, the cooling passages occupy at least 90% of the distance between the lateral side faces.

In a further embodiment of any of the foregoing embodiments, the outlet slots open at the inner face.

In a further embodiment of any of the foregoing embodiments, the outlet slots open at the outer face.

In a further embodiment of any of the foregoing embodiments, the outlet slots open at an aft face on the platform trailing end.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
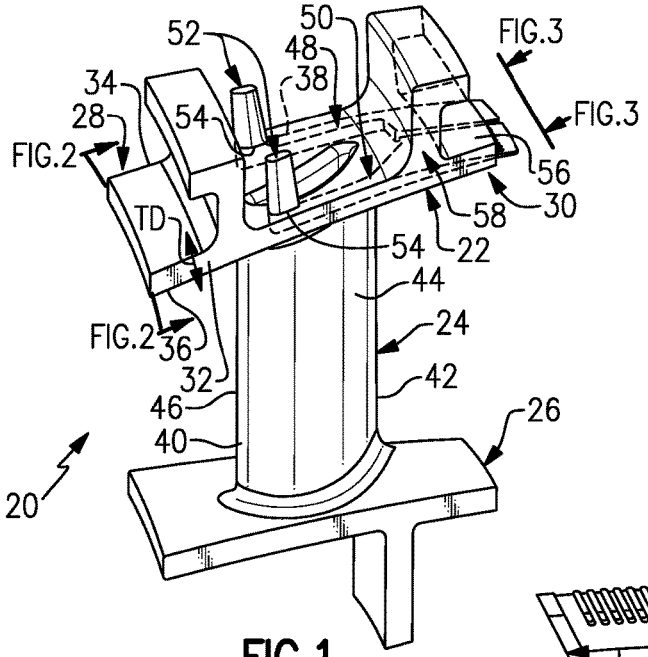
FIG. 1 illustrates an example airfoil that has a plurality of cooling passages with outlet slots at the trailing end of the platform.

FIG. 1 illustrates an example airfoil 20. In this example, the airfoil 20 is depicted as a static vane and can be used in a gas turbine engine turbine section. Although the examples herein may be described in connection with the static vane, it is to be understood that this disclosure is also applicable to rotatable blades.

in this example, the airfoil 20 includes a platform 22 and an airfoil portion 24 that extends outwardly from the platform 22. For an airfoil vane, there is also an additional platform 26 at the opposed end of the airfoil portion 24. When mounted in an engine or turbomachine, the platform 22 is a radially outer platform and the platform 26 is a radially inner platform. The examples herein could also be applied to the inner platform 26.

The platform 22 includes platform leading and trailing ends 28/30, lateral side faces 32/34, and inner and outer faces 36/38. The airfoil portion 24 extends outwardly from the inner face 36. The airfoil portion 24 includes airfoil leading and trailing ends 40/42 and side walls 44/46 that join the airfoil leading and trailing ends 40/42.

The platform 22 includes a plurality of cooling passages 48/50. Although there are two distinct cooling passages 48/50 in this example, modified examples could have only a single one of the cooling passages 48/50 or a single combined cooling passage.

Figure 2:
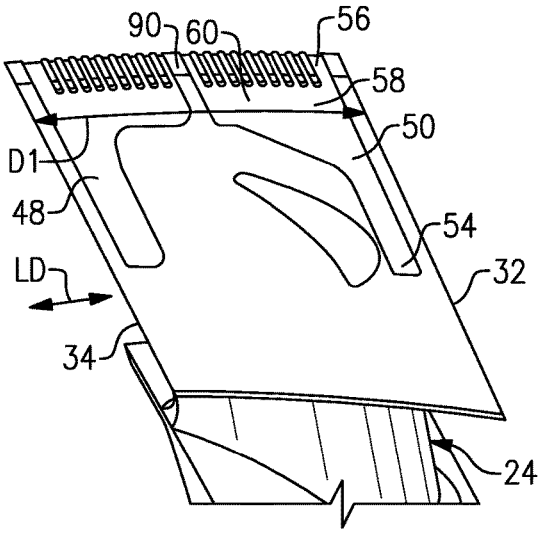
FIG. 2 is a sectional view through the platform of the airfoil of FIG. 1.

In FIG. 1, casting cores 52 are depicted in the airfoil 20 where the cooling passages 48/50 are formed upon removal of the cores 52. Although each core 52 is shown as a single piece, the cores 52 could alternatively be two or more pieces to form the cooling passages 48/50. FIG. 2 also illustrates a cross-section of the platform according to the section line in FIG. 1, to depict the geometry of the cooling passages 48/50. Each of the cooling passages 48/50 has an inlet 54 at a forward location, relative to the platform leading and trailing ends 28/30. In this example, the inlet 54 is at least even with the airfoil portion 24. That is, in the axial direction from the platform trailing end 30 to the platform leading end 28, the location of the inlets 54 is at least axially aligned with the airfoil 24 or is forward of the airfoil portion 24.

Figure 3:
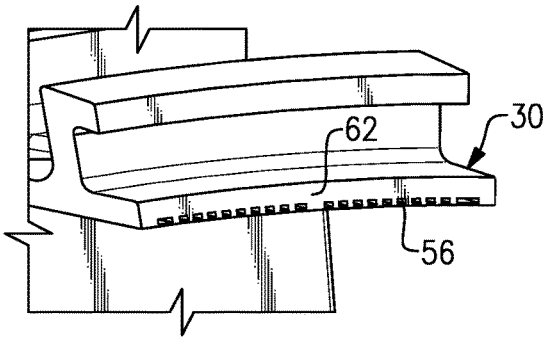
FIG. 3 is a view of the trailing end of the platform of the airfoil in FIG. 1.

The cooling passages 48/50 each also include outlet slots 56, which can also be seen, in-part, in the view of the trailing end 30 shown in FIG. 3. In one example, the outlet slots 56 diverge to the surface to diffuse cooling air upon discharge. Additionally or alternatively, the outlet slots 56 can be angled circumferentially and/or radially to adjust mixing of the air into the core gas stream.

Intermediate passage portions 58 of cooling passages 48/50 extend from the respective inlets 54 to the outlet slots 56. Each of the intermediate passage portions 58 includes a common manifold region 60 that feeds the outlet slots 56.

In this example, the cooling passages 48/50 are relatively wider in a lateral direction, represented at LD in FIG. 2, between the lateral side faces 32/34 than in a thickness direction, represented at TD in FIG. 1, between the inner and outer faces 36/38. In one further example, the cooling passages 48/50 occupy at least 90% of the lateral distance at the maximum width of the cooling passages 48/50, represented at D1 in FIG. 2, between the lateral sides 32/34. Thus, the cooling passages 48/50 are relatively broad, thin passages that thus facilitate internal cooling of the platform 22.

Figure 4:
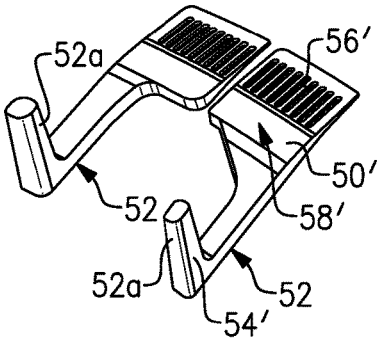
FIG. 4 illustrates casting cores that can be used to form the cooling passages in the platform of the airfoil of FIG. 1.

The airfoil 20 is fabricated by investment casting a metallic alloy in an investment mold around the cores 52, which are also individually shown in FIG. 4. Each of the cores 52 include a printout portion 52*a* that facilitates supporting the cores in the mold and also serves to form the inlets 54 of the cooling passages 48/50. As can be appreciated, the cores 52 include sections that correspond to the above-described portions of the cooling passages 48/50 with regard to the inlets 54, outlet slots 56, and intermediate passage portions 58. The corresponding sections of the cores 52 are designated with the same numerals of the cooling passages but with a prime (').

Figure 5:
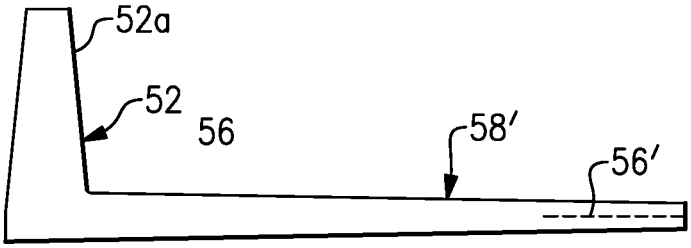
FIG. 5 illustrates a side view of one of the cores of FIG. 4.

FIG. 5 shows a side view of one of the cores 52. In this example, the core 52 tapers in thickness along the length from the printout 52*a*, which forms the inlet 54, to the outlet slots 56'. Thus, the cooling passage 48/50 also taper in thickness between the inlet 54 and the outlet slots 56.

Figure 6:
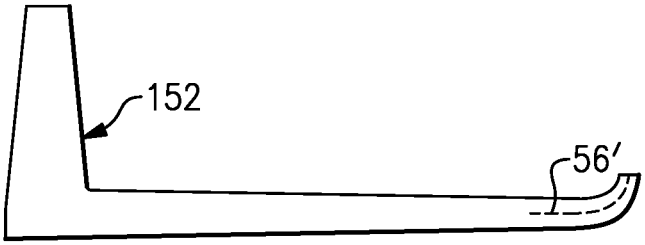
FIG. 6 illustrates a modified core with an end that turns up such that the outlet slots formed will open at an outer face of the platform.
Figure 7:
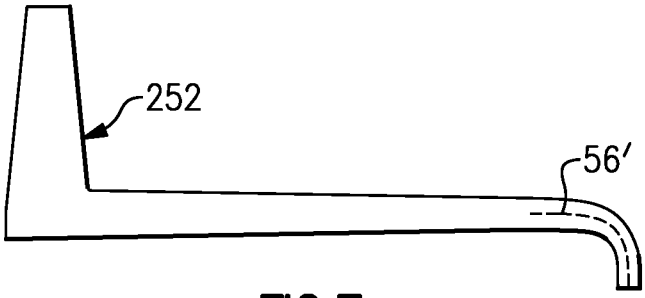
FIG. 7 illustrates a modified core with an end that turns down such that the outlet slots formed will open at an inner face of the platform.

In this example, the end of the core 52 with the outlet slots 56' is substantially linear such that the outlet slots 56 of the cooling passages 48/50 open at an aft face 62 on the platform trailing end 30 (FIG. 3). FIG. 6 illustrates a modified example core 152 in which the end with the outlet slots 56' turns upwards such that the outlet slots 56 of the cooling passages 48/50 open at the outer face 38 of the platform 22. FIG. 7 illustrates another example core 252 in which the end with the outlet slots 56' turns downward such that the outlet slots 56 of the cooling passages 48/50 open at the inner face 36 of the platform 22. Thus, in one further example, there can be a family of cores 52/152/252 that have similar or identical geometry with the exception of the ends with the outlet slots 56'. During fabrication of the airfoil 20, one of the cores 52/152/252 can be selected in accordance with cooling performance requirements of the airfoil 20 and downstream components that may be cooled using the discharged cooling air from the outlet slots 56.

Figure 8:
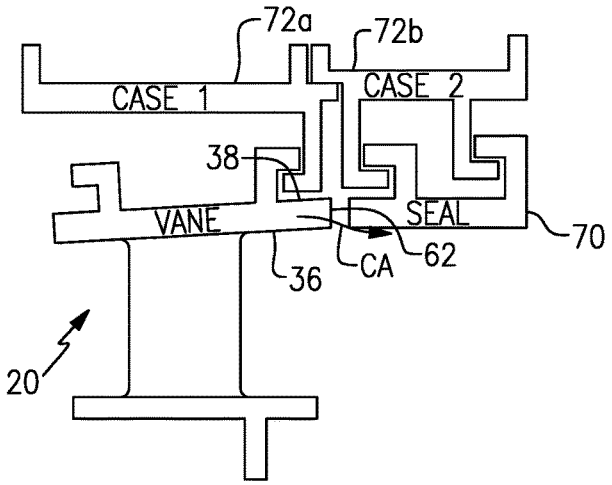
FIG. 8 shows discharging cooling air through an aft face at the trailing end of an airfoil platform to impinge on a downstream seal.

For example, the airfoil 20 is shown in FIG. 8 in a location in an engine that is axially forward of a seal 70 that is supported by case elements 72*a* and 72*b*. In this example, the core 52 was used to form the outlet slots 56 and thus the outlet slots 56 open at the aft face 62 of the trailing end 30. Cooling air, represented at CA in FIG. 8, is discharged through the outlet slots 56 and impinges upon the forward edge of the seal 70 to thus provide cooling to that forward edge.

Figure 9:
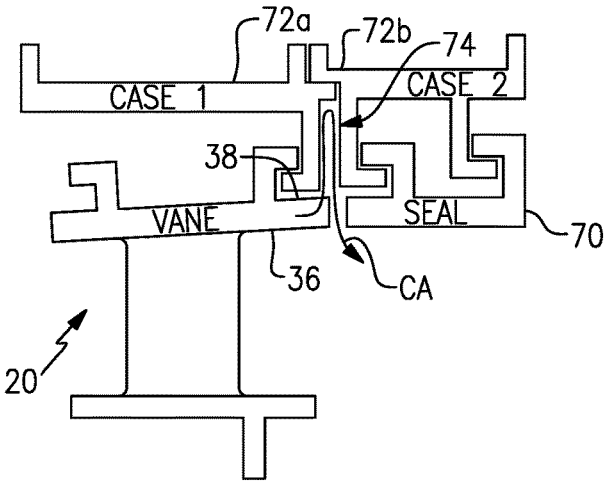
FIG. 9 shows discharging cooling air through an outer face at the trailing end of an airfoil platform into a cavity adjacent the airfoil and a downstream seal.

FIG. 9 illustrates another example in which the core 152 was used to form the outlet slots 56. In this example, the cooling air CA is thus discharged outwardly toward a cavity 74 between the case elements 72*a* and 72*b* to thus provide cooling to the cavity 74.

Figure 10:
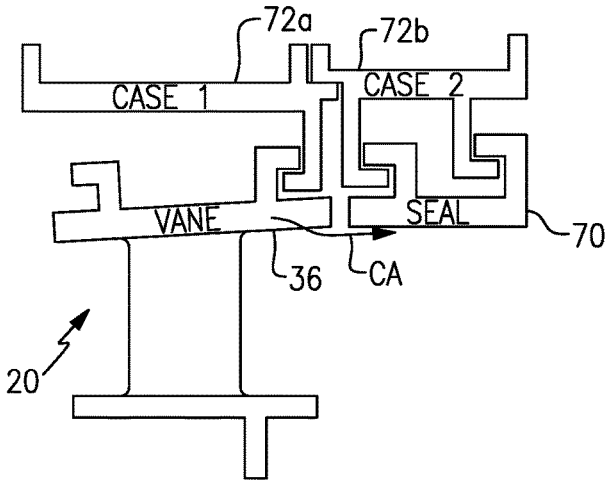
FIG. 10 shows discharging cooling air through an inner face at the trailing end of an airfoil platform to provide film cooling of the platform and at least a portion of a downstream seal.

FIG. 10 illustrates another example in which the core 252 was used to form the outlet slots 56. Thus, the cooling air CA is discharged through the inner face 36 into the main gas path and serves to film cool the trailing end 30 of the platform 22 and also the seal 70. Accordingly, depending on the selected core 52/152/252, the outlet slots 65 can serve multi-purposes.

Figure 11A:
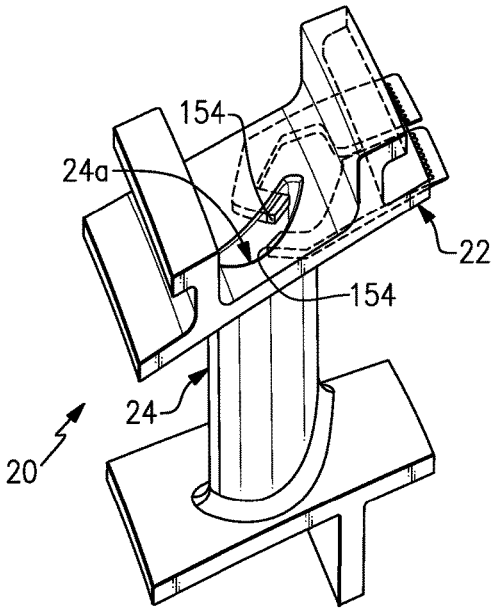
FIG. 11A illustrates another example airfoil, with cores that form a plurality of cooling passages with inlets that open to an airfoil cavity.
Figure 11B:
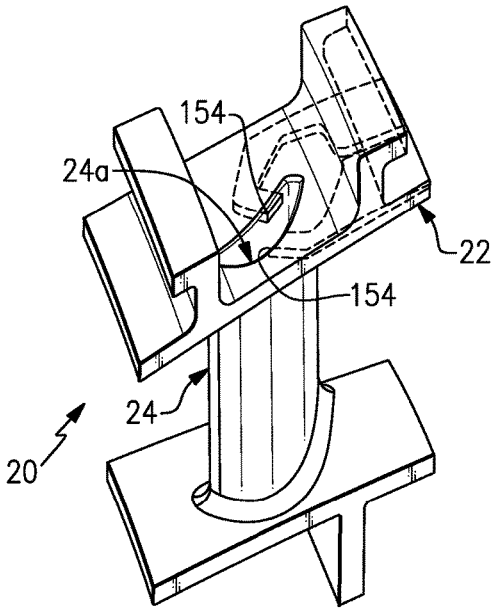
FIG. 11B illustrates the airfoil of FIG. 11A, without the cores.

FIG. 11A illustrates another example airfoil 120 with cores, and FIG. 11B illustrates the airfoil 120 without cores. The airfoil 120 is substantially similar to the airfoil 20 but in the airfoil 20 the inlets 54 open at the outer face 38 of the platform 22 such that the cooling air is directly provided from a source of cooling air, typically a compressor, into the cooling passages 48/50. In the airfoil 120, the inlets 154 open at a cavity 24*a* of the airfoil portion 24. The cooling air is thus provided into the cooling passages 48/50 from the cavity 24*a*.

Figure 12:
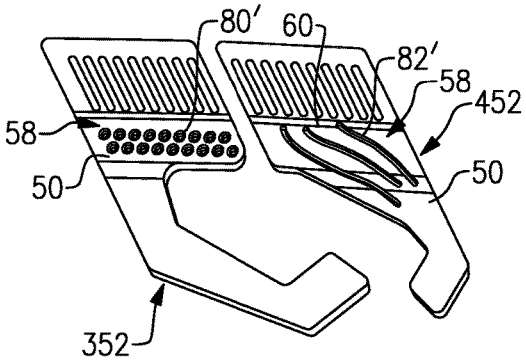
FIG. 12 illustrates casting cores that can be used to form cooling passages in a platform.

FIG. 12 illustrates a further example of another core 352. In this example, the manifold region 60 of the intermediate passage portion 58 includes pedestals 80' that will form corresponding pedestals within the cooling passages 48/50. The pedestals serve to mix and/or meter the cooling air as it flows through the cooling passage. Alternatively or in addition to the pedestals 80', as shown in another example core 452, the manifold region 60 can include ribs 82' that form corresponding ribs in the cooling passages 48/50. For example, the ribs may be used to guide or direct flow of the cooling air through the common manifold region 60 into the outlet slots 56.

Figure 13:
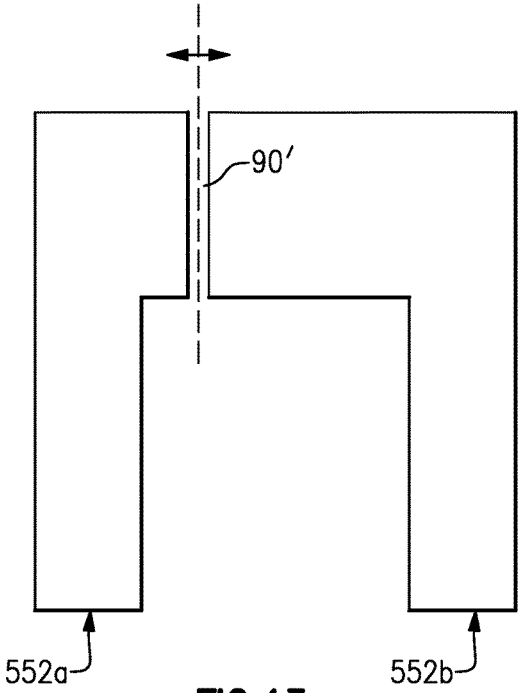
FIG. 13 illustrates the position of the metal rib that separates cores 552*a* and 552*b*

FIG. 13 illustrates further example cores 552*a*/552*b*. For example, the cores 52 (FIG. 4) are substantially symmetric such that there was a dividing rib 90 (FIG. 2) that separated the cooling passages 48/50. Thus, in that example, there would be a relatively equal flow of cooling air passing through both cooling passages 48/50. In contrast, the cores 552*a* and 552*b* are not equal or symmetric and the location of the rib 90' that will form a corresponding rib in the airfoil is shifted laterally to be nearer to one of the lateral sides 32/34 of the platform 22. Thus, the corresponding manifold region of the core 552*b* will be relatively larger than the manifold region of the core 552*a*. For example, the lateral location of the rib portion 90' can be shifted toward the side that has greater cooling requirements. For instance, the cooling air that flows through the smaller cooling passage that is formed by the core 552*a* obtains less heat while flowing through the platform 22 and is thus cooler upon discharge from the platform 22 than cooling air discharged from the relatively larger cooling passage corresponding to the core 552*b*. That is, the cooling air discharged from the cooling passage corresponding to the core 552*a* is relatively cooler and thus can more effectively cool the trailing end 30 of the platform and downstream components, such as the cavity 74 and/or seal 70.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil comprising:

a platform including platform leading and trailing ends, lateral side faces, and inner and outer faces; and an airfoil portion extending outwardly from the inner face of the platform, the platform including a cooling passage having an inlet at a forward location, outlet slots at the platform trailing end, and an intermediate passage portion extending from the inlet to the outlet slots, the intermediate passage portion including a common manifold region that feeds the outlet slots and the intermediate passage portion tapering in a thickness direction from the inlet to the outlet slots, wherein the thickness direction is between the inner and outer faces.

2. The airfoil as recited in claim 1, wherein the cooling passage is relatively wider in a lateral direction between the lateral side faces than in the thickness direction between the inner and outer faces.

3. The airfoil as recited in claim 1, wherein the manifold region includes pedestals.

4. The airfoil as recited in claim 1, wherein the manifold region includes elongated ribs.

5. The airfoil as recited in claim 1, wherein the outlet slots open at the inner face.

6. The airfoil as recited in claim 1, wherein the outlet slots open at the outer face.

7. The airfoil as recited in claim 1, wherein the outlet slots open at an aft face on the platform trailing end.

8. The airfoil as recited in claim 1, wherein the inlet opens at a cavity of the airfoil portion.

9. The airfoil as recited in claim 1, wherein the inlet opens at the outer face.

10. The airfoil as recited in claim 1, wherein the cooling passage extends over at least 50% of a length of the platform between the platform leading and trailing ends.

11. The airfoil as recited in claim 1, wherein the outlet slots include a turn.

12. The airfoil as recited in claim 1, wherein the cooling passage extends over at least 50% of a length of the platform between the platform leading and trailing ends, and wherein the cooling passage is relatively wider in a lateral direction between the lateral side faces than in the thickness direction.

* * * * *